US005906350A

United States Patent [19]

Kao

[11] Patent Number: 5,906,350

[45] **Date of Patent: *May 25, 1999**

[54] WRENCH SUSPENSION RACK

[76] Inventor: Jui-Chien Kao, No. 358, Tunghsing Rd., Shuwang Li, Tali City, Taichung Hsien, Taiwan

[ * ] Notice: This patent is subject to a terminal disclaimer.

[21] Appl. No.: 08/918,995

[22] Filed: Aug. 27, 1997

[51] Int. Cl.[6] ..... B65D 75/56

[52] U.S. Cl. ..... 248/688; 206/349; 206/377; 206/481; 206/806; 211/70.6; 248/317

[58] Field of Search ..... 248/682, 693, 248/317, 309.1, 222.11, 222.12, 214; 211/70.6; 206/349, 377, 481, 806

[56] References Cited

U.S. PATENT DOCUMENTS

| | | | |
|---|---|---|---|
| 3,275,274 | 9/1966 | Hutcheon | 248/309.1 |
| 3,927,765 | 12/1975 | Beal | 206/481 |
| 4,450,961 | 5/1984 | Bies et al. | 206/349 |
| 4,634,005 | 1/1987 | Kulzer et al. | 211/70.6 X |
| 4,729,473 | 3/1988 | Kulzer et al. | 206/481 X |
| 5,044,591 | 9/1991 | Huang | 211/70.6 X |
| 5,484,056 | 1/1996 | Wood | 206/349 |
| 5,501,330 | 3/1996 | Betts | 206/349 |
| 5,713,467 | 2/1998 | Kao | 211/70.6 X |

*Primary Examiner*—Derek J. Berger
*Attorney, Agent, or Firm*—Hamilton, Brook, Smith & Reynolds, P.C.

[57] ABSTRACT

A suspension rack includes a suspension plate having a first side, a second side, and two end portions each defining a hole and an L-shaped cavity located adjacent to the hole. A U-shaped supporting bracket is mounted on the first side of the suspension plate and includes a vertical arm, two side arms each extending from the vertical arm to the suspension plate, and two extensions each extending from an associated side arm to abut on the first side of the suspension plate. Two snapping members each include an enlarged head abutting on an associated extension, a shank slidably received in a bore defined in each of the two extensions and in the hole of an associated end portion of the suspension plate, and an enlarged abutting edge abutting on the second side of the suspension plate. Two L-shaped resilient hook portions each extend from an associated extension and are each detachably received in the L-shaped cavity of the suspension plate.

2 Claims, 5 Drawing Sheets

WRENCH SUSPENSION RACK

FIELD OF THE INVENTION

The present invention relates to a suspension rack, and more particularly to a wrench suspension rack.

BACKGROUND OF THE INVENTION

A conventional wrench suspension rack can be used in a retail outlet such as a hardware store for displaying a plurality of wrenches to be chosen by consumers. However, by such an arrangement, a person can steal the wrenches by freely detaching them from the wrench suspension rack.

Very often, anti-theft magnetic bar codes can only be printed on the wrench suspension rack, and cannot be printed on the wrenches whose surfaces are smooth, thus, sensors co-operating with the magnetic bar codes cannot detect the wrenches when they are detached from the wrench suspension rack. Therefore, the wrench suspension rack cannot be used for deterring theft.

The present invention has arisen to mitigate and/or obviate disadvantages of the conventional wrench suspension rack.

SUMMARY OF THE INVENTION

In accordance with one aspect of the present invention, there is provided a suspension rack comprising a suspension plate vertically disposed and having a first side, a second side, and two end portions each defining a hole and each defining an L-shaped cavity located adjacent to the hole.

A U-shaped supporting bracket is fixedly mounted on the first side of the suspension plate and includes a vertical arm disposed in parallel with the suspension plate, two side arms each having a first end portion extending from one distal end of the vertical arm to the suspension plate, and two extensions each extending from a second end portion of a corresponding one of the two side arms, each abutting on the first side of the suspension plate, and each defining a bore.

Two snapping members each include an enlarged head abutting on a corresponding one of the two extensions, a shank extending from the enlarged head and slidably received in the bore of a corresponding one of the two extensions and the hole of a corresponding one of the two end portions of the suspension plate, and an enlarged abutting edge extending from the shank and abutting on the second side of the suspension plate.

Two L-shaped resilient hook portions each extend from a corresponding one of the two extensions of the supporting bracket and are each detachably received in the L-shaped cavity of a corresponding one of the two end portions of the suspension plate.

Further features of the present invention will become apparent after a careful reading of the detailed description with reference to the accompanying drawings.

DETAILED DESCRIPTION OF THE PREFERRED EMBODIMENTS

Figure 1:
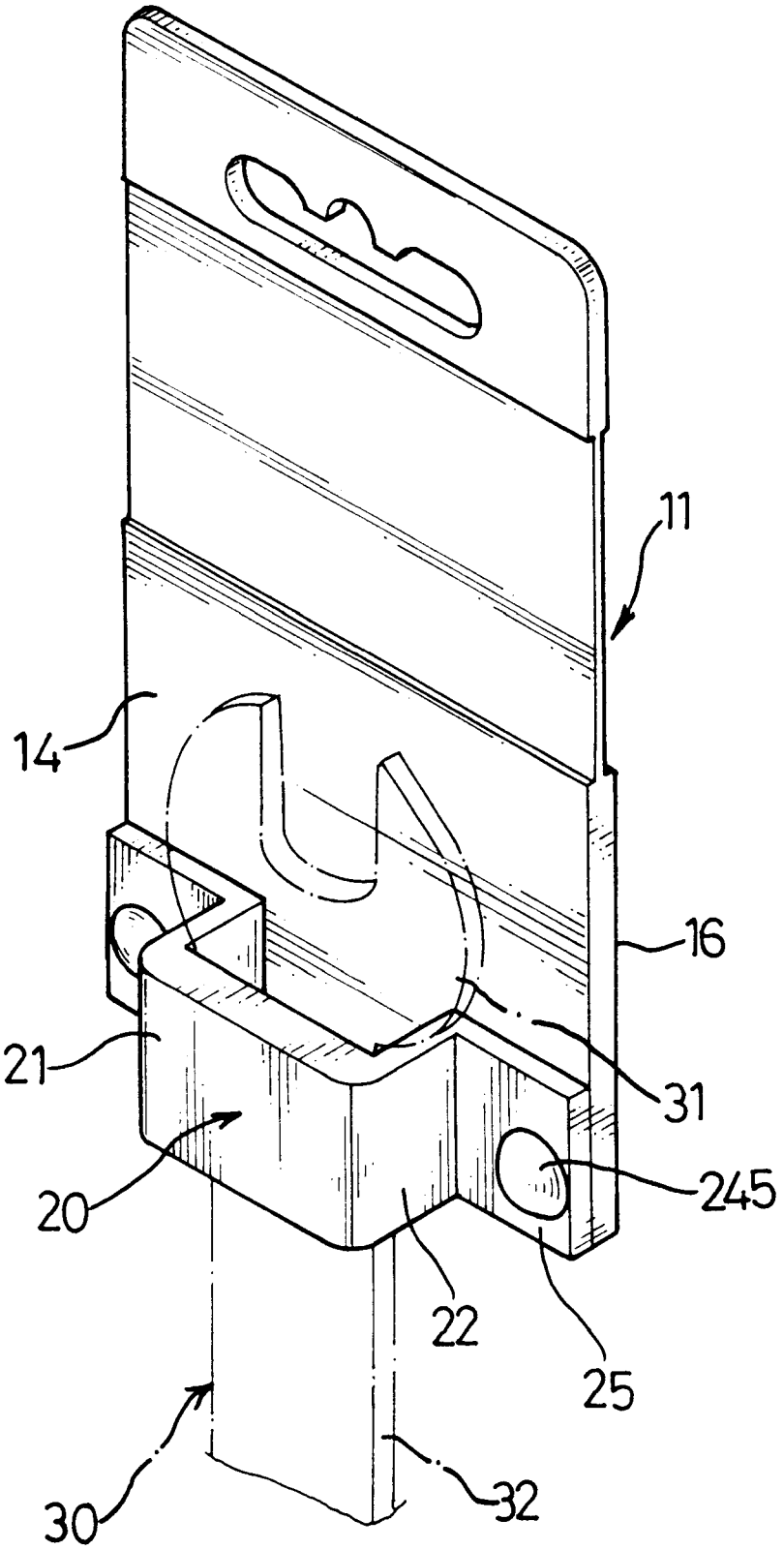
FIG. 1 is a perspective view of a wrench suspension rack in accordance with a first embodiment of the present invention.
Figure 2:
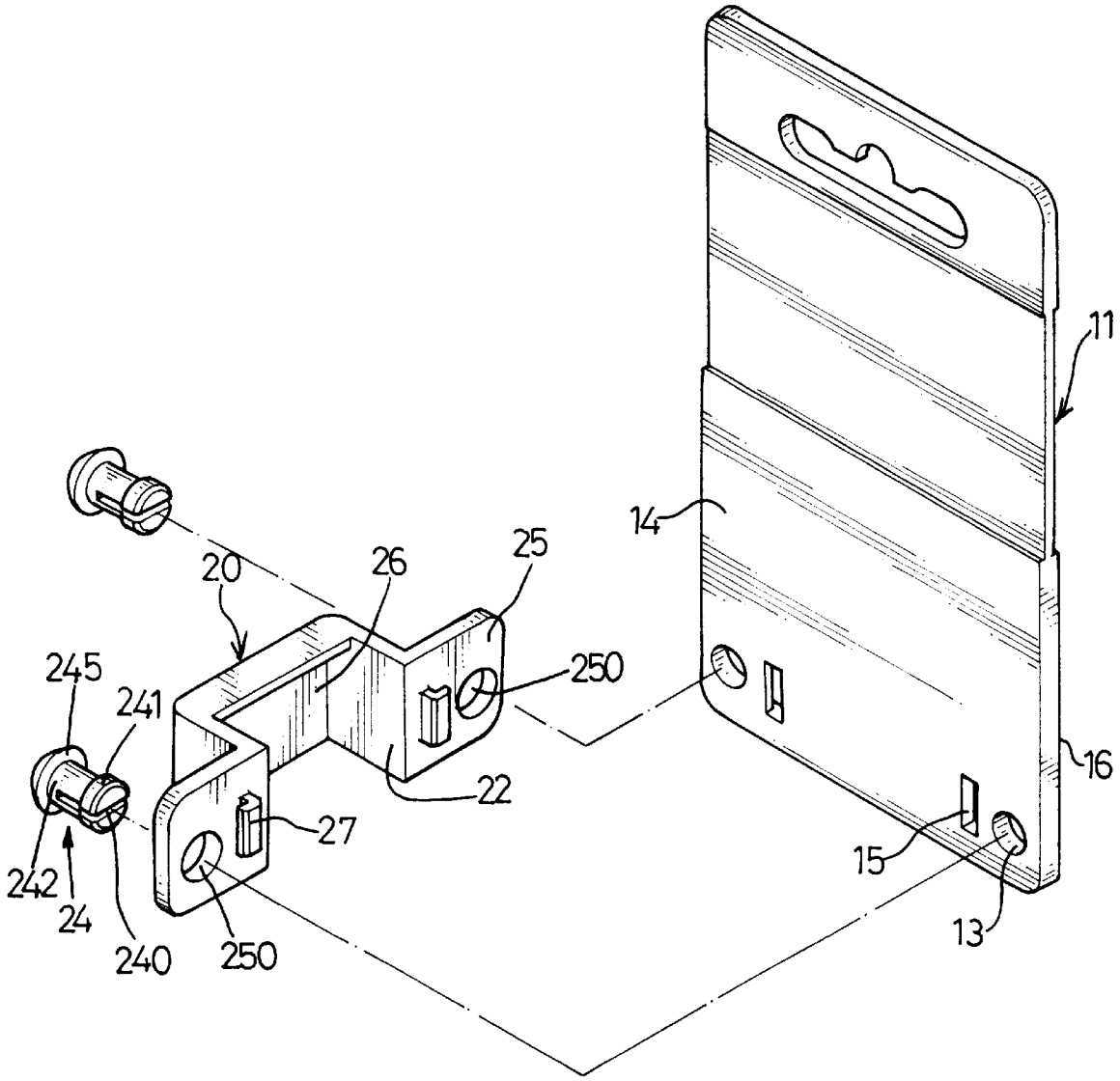
FIG. 2 is an exploded view of FIG. 1.
Figure 3:
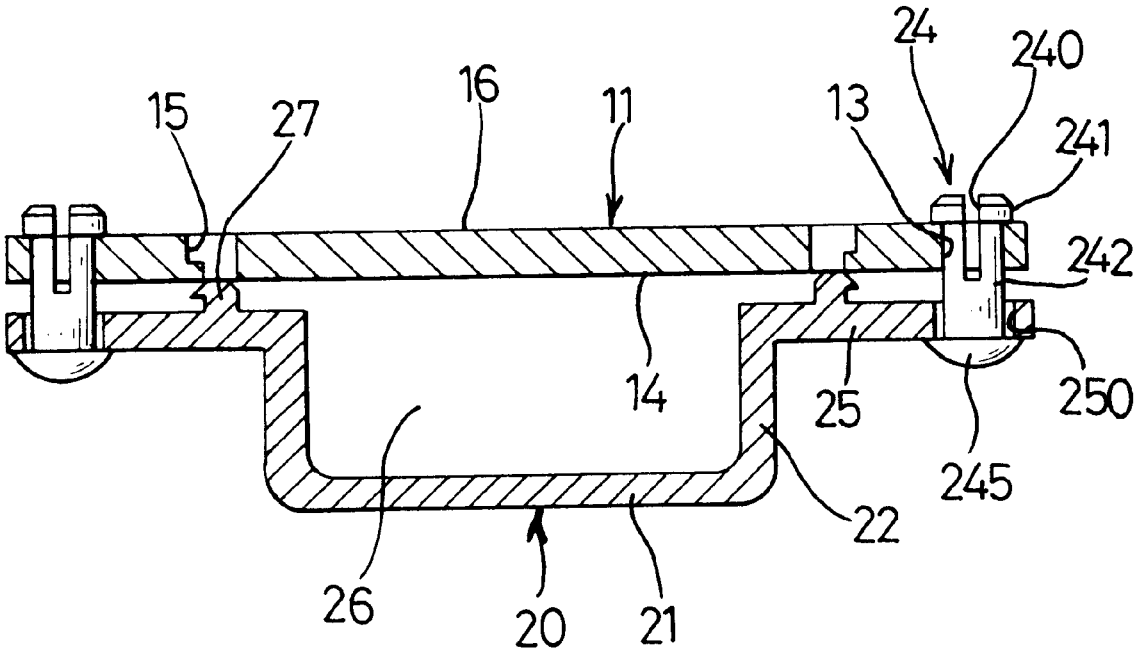
FIG. 3 is a top plan cross-sectional view of FIG. 1.

Referring to the drawings, and initially to FIGS. 1–4, a suspension rack in accordance with a first embodiment of the present invention can be adapted for attaching an article such as a wrench 30 to a fixed structure such as a vertical wall (not shown).

The suspension rack comprises a suspension plate 11 vertically disposed and including a first side 14, a second side 16, and two end portions each defining a hole 13 therein and each defining an L-shaped cavity 15 therein and located adjacent to the hole 13.

A substantially U-shaped supporting bracket 20 is fixedly mounted on the first side 14 of the suspension plate 11 and comprises a vertical arm 21 disposed in parallel with the suspension plate 11, two side arms 22 for supporting an enlarged head 31 of the wrench 30 and each having a first end portion extending from one distal end of the vertical arm 21 to the suspension plate 11, and two extensions 25 each extending from a second end portion of a corresponding one of the two side arms 22 to abut on the first side 14 of the suspension plate 11 and each defining a bore 250.

A receiving space 26 is defined between the vertical arm 21 and the two side arms 22 for receiving a shank 32 of the wrench 30 therein.

Two snapping members 24 each include a cone-shaped enlarged head 245 abutting on a corresponding one of the two extensions, a shank 242 extending from the enlarged head 245 and slidably received in the bore 250 of a corresponding one of the two extensions 25 and in the hole 13 of a corresponding one of the two end portions of the suspension plate 11, and an enlarged abutting edge 241 extending from the shank 242 and abutting on the second side 16 of the suspension plate 11.

The enlarged abutting edge 241 of each of the two snapping members 24 transversely defines a slit 240 therein, thereby facilitating the enlarged abutting edge 241 to be inserted into the hole 13.

The enlarged abutting edge 241 of each of the two snapping members 24 has a dimension greater than the diameter of the hole 13, thereby preventing each of the two snapping members 24 from detaching from the suspension plate 11.

Two L-shaped resilient hook portion 27 each extend from a corresponding one of the two extensions 25 and are each detachably received in the L-shaped cavity 15 of a corresponding one of the two end portions of the suspension plate 11.

In operation, the supporting bracket 20 can be fitted onto the first side 14 of the suspension plate 11, with the enlarged abutting edge 241 of each of the two snapping members 24 being pressed to be inserted into the hole 13, thereby suspending the enlarged head 31 of the wrench 30 on the supporting bracket 20, and thereby attaching the wrench 30 to the suspension plate 11 as shown in FIG. 1.

Accordingly, by such an arrangement, the wrench 30 has another enlarged head (not shown) located opposite to the enlarged head 31 such that the wrench 30 cannot be detached from the supporting bracket 20, thereby preventing someone from unauthorizedly detaching the wrench 30 from the suspension plate 11, and ultimately achieving an anti-theft purpose.

Figure 4:
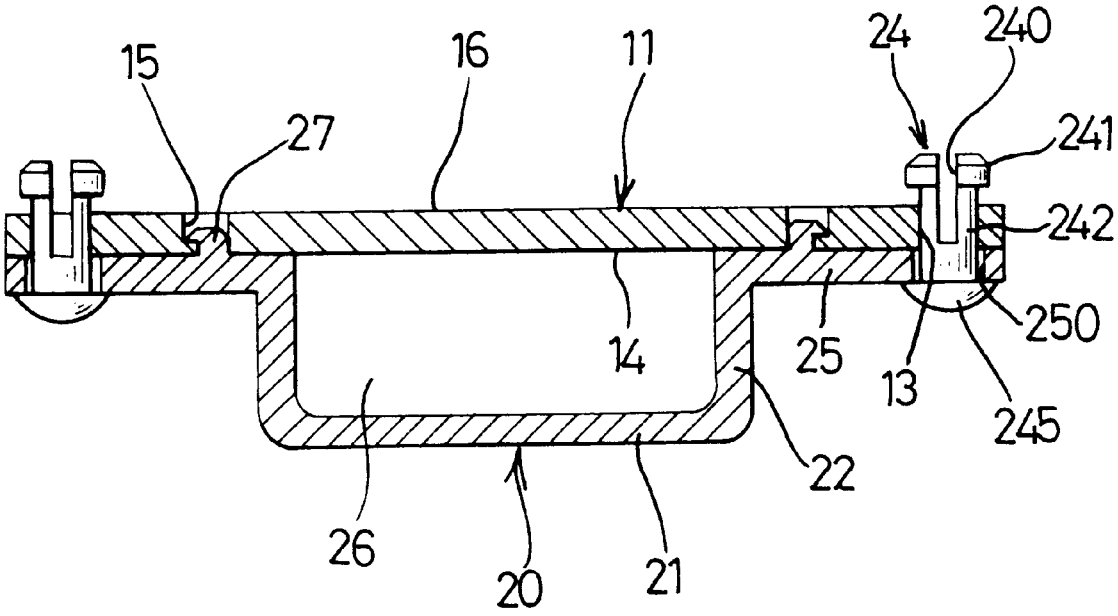
FIG. 4 is an operational view of FIG. 3.

A consumer or an employee of the retail outlet can use a tool such as a pair of scissors to cut off the enlarged abutting edge 241 of each of the two snapping members 24 as shown in FIG. 4, thereby detaching the wrench 30 from the suspension plate 11 for use by exerting a relative outward force on the supporting bracket 20 and the suspension plate 11 to detach the resilient hooks 27 from the respective cavity 15.

The supporting bracket 20 can be again fitted onto the first side 14 of the suspension plate 11, with the resilient hooks 27 being pressed to be inserted into the respective cavity 15, thereby suspending the enlarged head 31 of the wrench 30 on the supporting bracket 20, and attaching the wrench 30 to the suspension plate 11 after use.

Figure 5:
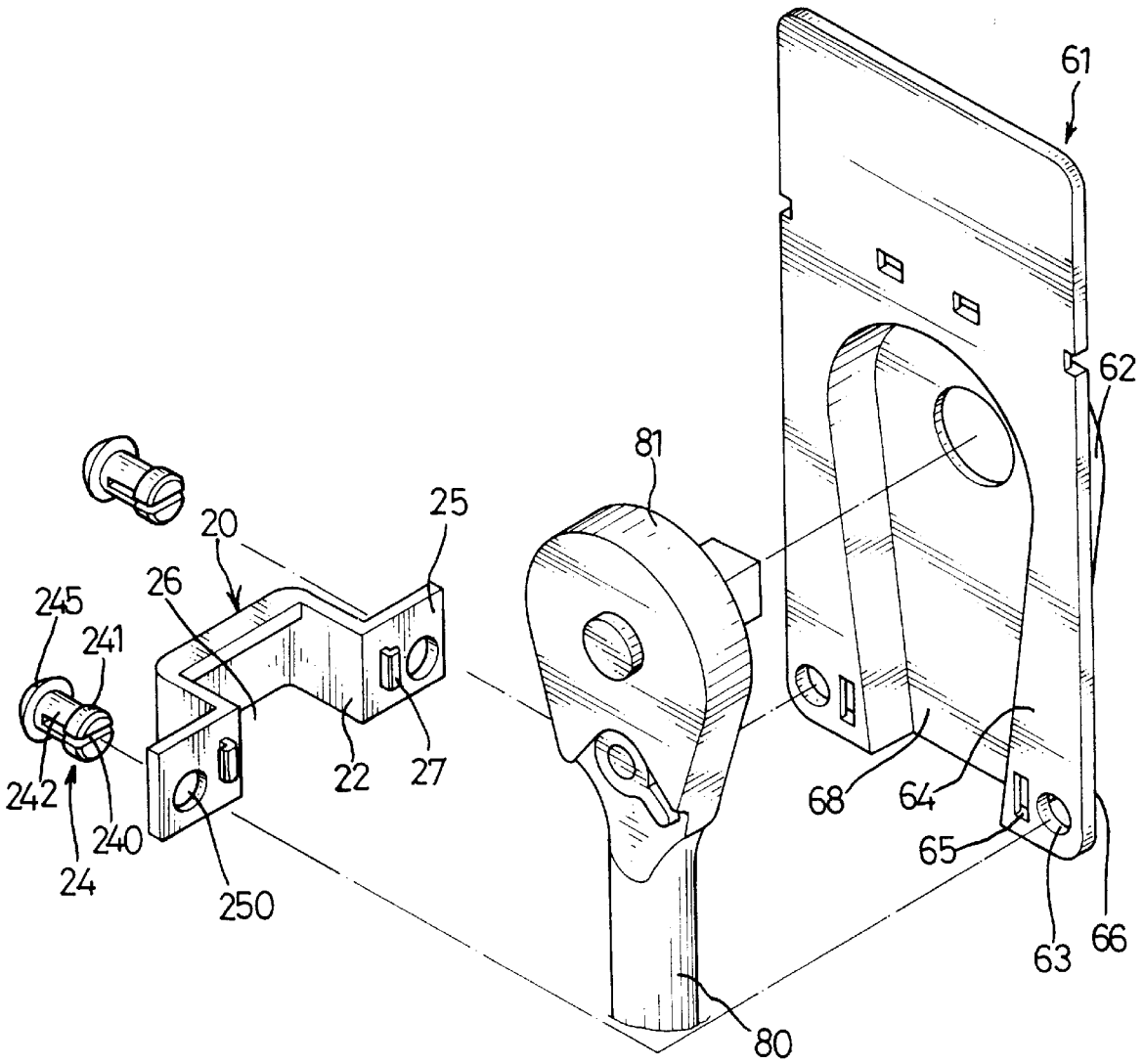
FIG. 5 is an exploded view of a wrench suspension rack according to a second embodiment of the present invention.

Referring now to FIG. 5, in accordance with a second embodiment of the present invention, the supporting bracket 20 is the same as that disclosed in the first embodiment.

A suspension plate 61 includes a first side 64, a second side 66, and two end portions each defining a hole 63 and an L-shaped cavity 65, a lug 62 formed on the second side 66, and a recess 68 defined in the lug 62 for receiving a driving head 81 of a ratchet wrench 80.

The supporting bracket 20 can be securely fitted to the suspension plate 61, thereby retaining the ratchet wrench 80 between the supporting bracket 20 and the suspension plate 61. The operation is similar to that as is disclosed in the first embodiment and thus will not be further described.

It should be clear to those skilled in the art that further embodiments of the present invention may be made without departing from the scope and spirit of the present invention.

What is claimed is:

1. A suspension rack comprising:

a suspension plate vertically disposed and including a first side, a second side, and two end portions each defining a hole therein and each defining an L-shaped cavity therein located adjacent to said hole;

a substantially U-shaped supporting bracket fixedly mounted on said first side of said suspension plate and comprising:

an arm disposed in parallel with said suspension plate;

two side arms each having a first end portion extending from one distal end of said arm to said suspension plate, and a receiving space defined between said arm and said two side arms; and two extensions each extending from a second end portion of a corresponding one of said two side arms, each abutting on said first side of said suspension plate, and each defining a bore;

two snapping members each including:

an enlarged head abutting on a corresponding one of said two extensions;

a shank extending from said enlarged head and slidably received in said bore of a corresponding one of said two extensions and in said hole of a corresponding one of said two end portions of said suspension plate; and an enlarged abutting edge extending from said shank and abutting on said second side of said suspension plate; and two L-shaped resilient hook portions each extending from a corresponding one of said two extensions and each detachably received in said L-shaped cavity of a corresponding one of said two end portions of said suspension plate.

2. The suspension rack in accordance with claim 1, wherein said enlarged abutting edge of each of said two snapping members transversely defines a slit therein.

* * * * *